US010385502B2

(12) United States Patent
Song et al.

(10) Patent No.: US 10,385,502 B2
(45) Date of Patent: Aug. 20, 2019

(54) CLOTHES TREATMENT APPARATUS AND CONTROL METHOD THEREOF

(71) Applicant: LG ELECTRONICS INC., Seoul (KR)

(72) Inventors: Seung Hyun Song, Changwon-si (KR); Hui Jae Kwon, Changwon-si (KR); Ki Hyuk Kim, Changwon-si (KR); Min Jung You, Changwon-si (KR); Ye Ji Um, Changwon-si (KR); Eun Young Jee, Changwon-si (KR); Ho Il Jeon, Changwon-si (KR); Jung Hwan Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/704,826

(22) Filed: Sep. 14, 2017

(65) Prior Publication Data

US 2018/0002860 A1 Jan. 4, 2018

Related U.S. Application Data

(62) Division of application No. 13/581,979, filed as application No. PCT/KR2011/001462 on Mar. 3, 2011, now Pat. No. 9,790,638.

(30) Foreign Application Priority Data

Mar. 3, 2010 (KR) ..... 10-2010-0018929
Mar. 3, 2010 (KR) ..... 10-2010-0018930
(Continued)

(51) Int. Cl.
*D06F 73/02* (2006.01)
*D06F 58/20* (2006.01)
*D06F 58/10* (2006.01)

(52) U.S. Cl.
CPC ..... *D06F 73/02* (2013.01); *D06F 58/10* (2013.01); *D06F 58/203* (2013.01)

(58) Field of Classification Search
CPC ..... D06F 58/10; D06F 58/203; D06F 7/02
See application file for complete search history.

(56) References Cited

U.S. PATENT DOCUMENTS 3,672,188 A 6/1972 Geschka et al.
3,732,628 A * 5/1973 Blevens ..... D06F 73/02 239/425
(Continued)

FOREIGN PATENT DOCUMENTS

DE 3600953 7/1987
DE 102005052960 5/2007
(Continued)

OTHER PUBLICATIONS

Machine Translation of JP 2005-118462 to Inoue et al., May 2005. (Year: 2005).*

*Primary Examiner* — Michael E Barr
*Assistant Examiner* — Benjamin L Osterhout
(74) *Attorney, Agent, or Firm* — Dentons US LLP

(57) ABSTRACT

A clothes treatment apparatus and a control method thereof are disclosed. The clothes treatment apparatus includes a fixed nozzle device and a moving nozzle device to supply at least one of steam and heated air to clothes. As a result, the clothes may be washed effectively or refreshed.

19 Claims, 9 Drawing Sheets

(30) Foreign Application Priority Data

Mar. 3, 2010 (KR) ..... 10-2010-0018931
Mar. 3, 2010 (KR) ..... 10-2010-0018932

(56) References Cited

U.S. PATENT DOCUMENTS 3,849,815 A * 11/1974 Frauendorf ..... D06F 73/02 223/51
3,868,835 A * 3/1975 Todd-Reeve ..... D06F 17/04 134/176
3,899,108 A * 8/1975 Frauendorf ..... D06F 73/02 223/51
4,391,602 A * 7/1983 Stichnoth ..... D06F 73/02 223/51
4,761,896 A * 8/1988 Miyata ..... D06F 43/088 34/611
5,359,786 A * 11/1994 Vierling ..... D06F 73/02 34/218
6,189,346 B1 * 2/2001 Chen ..... D06F 58/10 68/205 R
7,060,106 B2 6/2006 Kleker
7,137,211 B2 * 11/2006 Johnson ..... D06F 58/10 34/381
2001/0037590 A1 * 11/2001 MacGregor ..... D06F 73/02 38/3
2002/0154011 A1 * 10/2002 Pasin ..... D06F 73/02 340/540
2003/0126691 A1 * 7/2003 Gerlach ..... D06F 35/001 8/158
2005/0223502 A1 10/2005 Kleker
2006/0137206 A1 6/2006 Lee et al.
2006/0179678 A1 8/2006 Jonsson et al.
2008/0034609 A1 * 2/2008 Wolf ..... D06F 73/02 34/216
2008/0155757 A1 * 7/2008 Kim ..... D06F 58/10 8/149.3
2008/0256989 A1 * 10/2008 Jeong ..... D06F 58/14 68/5 C
2009/0113944 A1 * 5/2009 Kim ..... D06F 17/00 68/5 C
2009/0120140 A1 5/2009 Choi et al.
2009/0133298 A1 * 5/2009 Kim ..... D06F 58/10 38/14
2009/0151189 A1 * 6/2009 Moon ..... D06F 58/10 34/218
2009/0235464 A1 * 9/2009 Cassidy ..... D06F 17/04 8/137
2009/0260250 A1 * 10/2009 Moon ..... D06F 58/10 34/202
2012/0160269 A1 6/2012 Pyo et al.

FOREIGN PATENT DOCUMENTS

DE 1020009014910 A1 10/2009
EP 0816552 A2 * 1/1998 ..... D06F 71/16
JP 10-57697 A 3/1998
JP 3051182 U 8/1998
JP 2001-120899 A 5/2001
JP 2005-118462 5/2005
JP 2008-543407 A 12/2008
KR 20-0333004 Y1 11/2003
KR 10-0547653 B1 2/2006
KR 10-2006-0060211 A 6/2006
KR 10-0782375 B1 12/2007
KR 10-2008-0009481 A 1/2008
KR 10-0808193 B1 2/2008
KR 10-0839519 B1 6/2008
KR 10-2009-0013945 A 2/2009
KR 10-2009-0048760 A 5/2009
KR 10-2009-0061857 A 6/2009
KR 10-2009-0105084 A 10/2009
KR 10-2010-0022382 A 3/2010
SU 1125318 A 11/1984
WO 2004/091359 A2 10/2004
WO 2006/134364 12/2006

* cited by examiner

[Fig. 1]
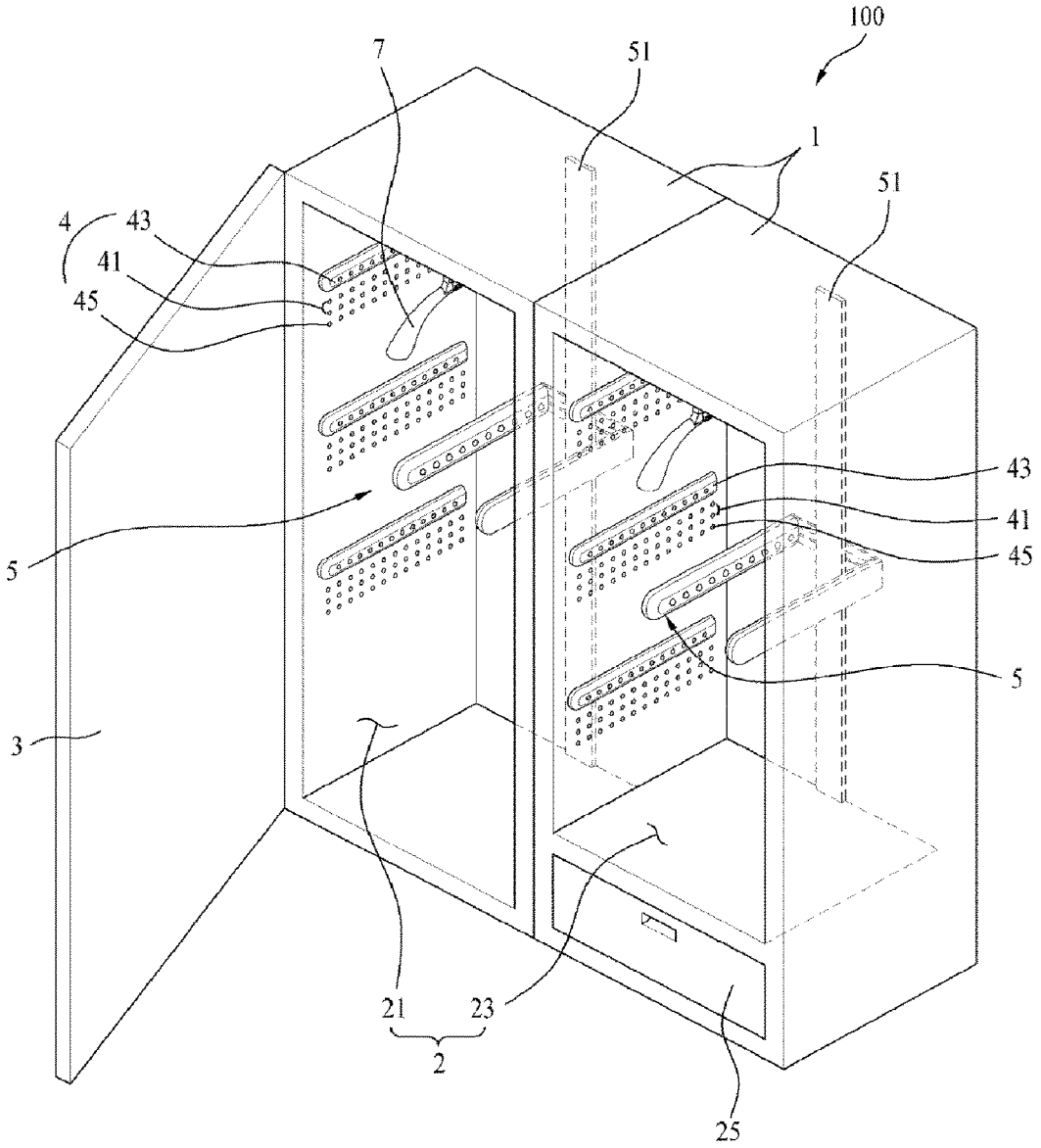

[Fig. 2]
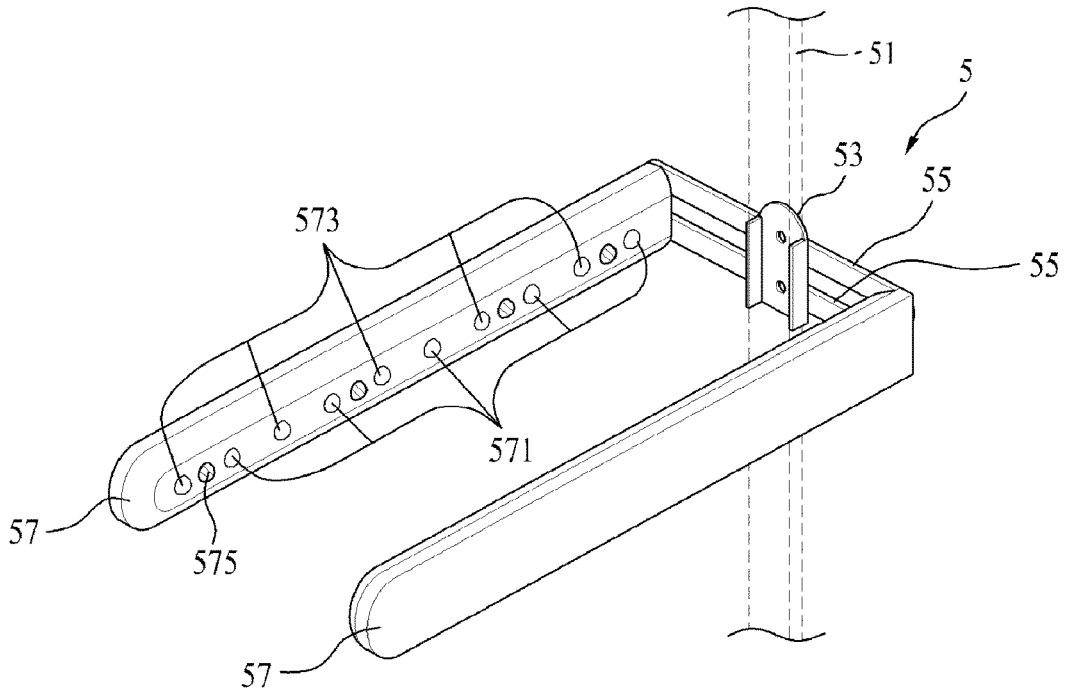

[Fig. 3]
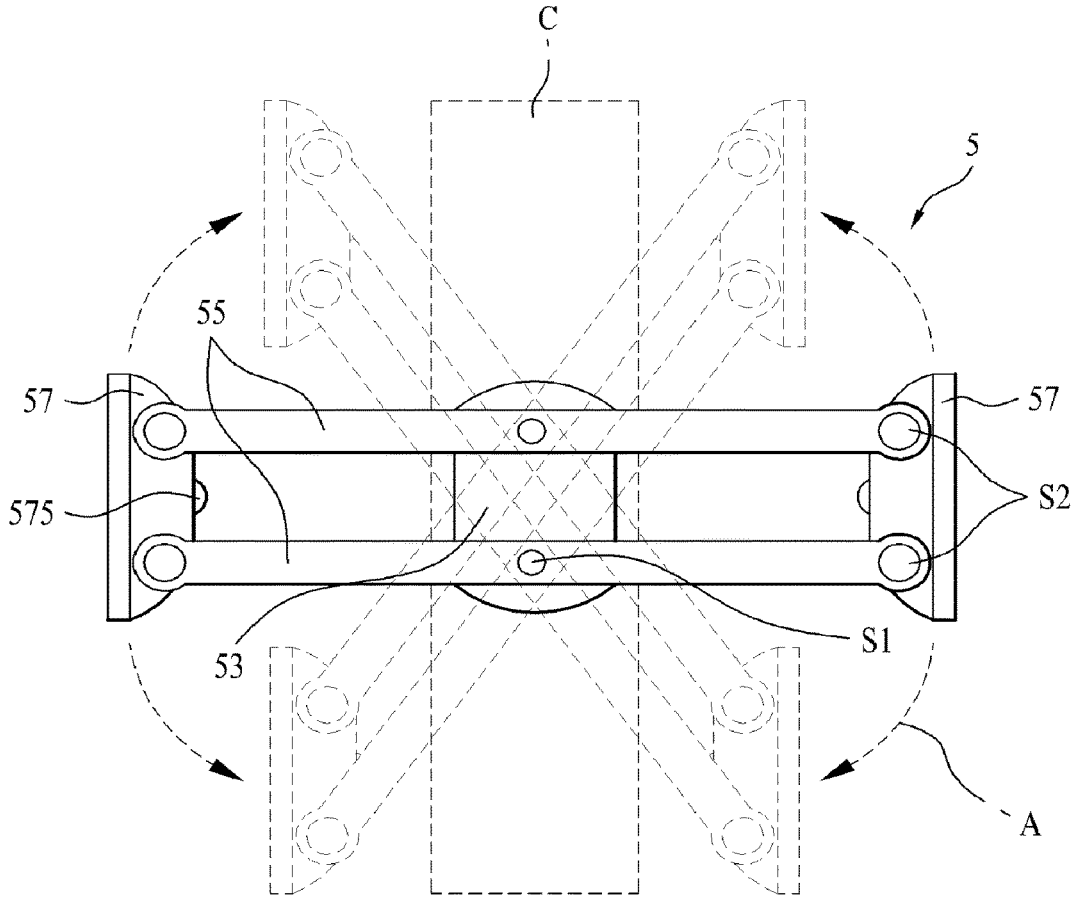

[Fig. 4]
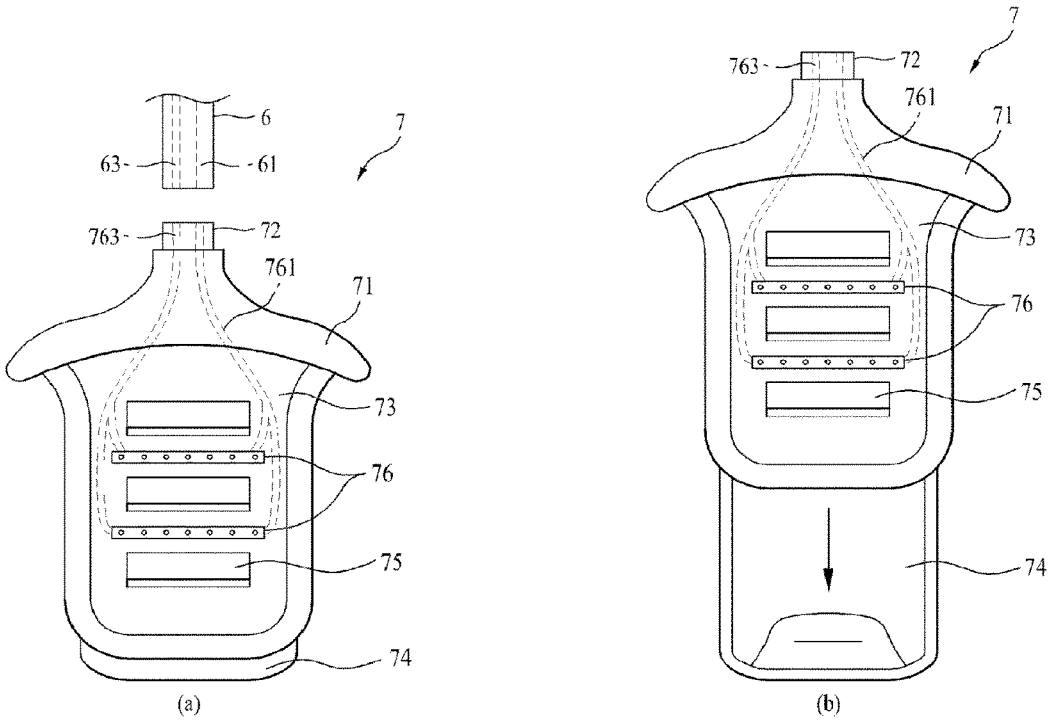

[Fig. 5]
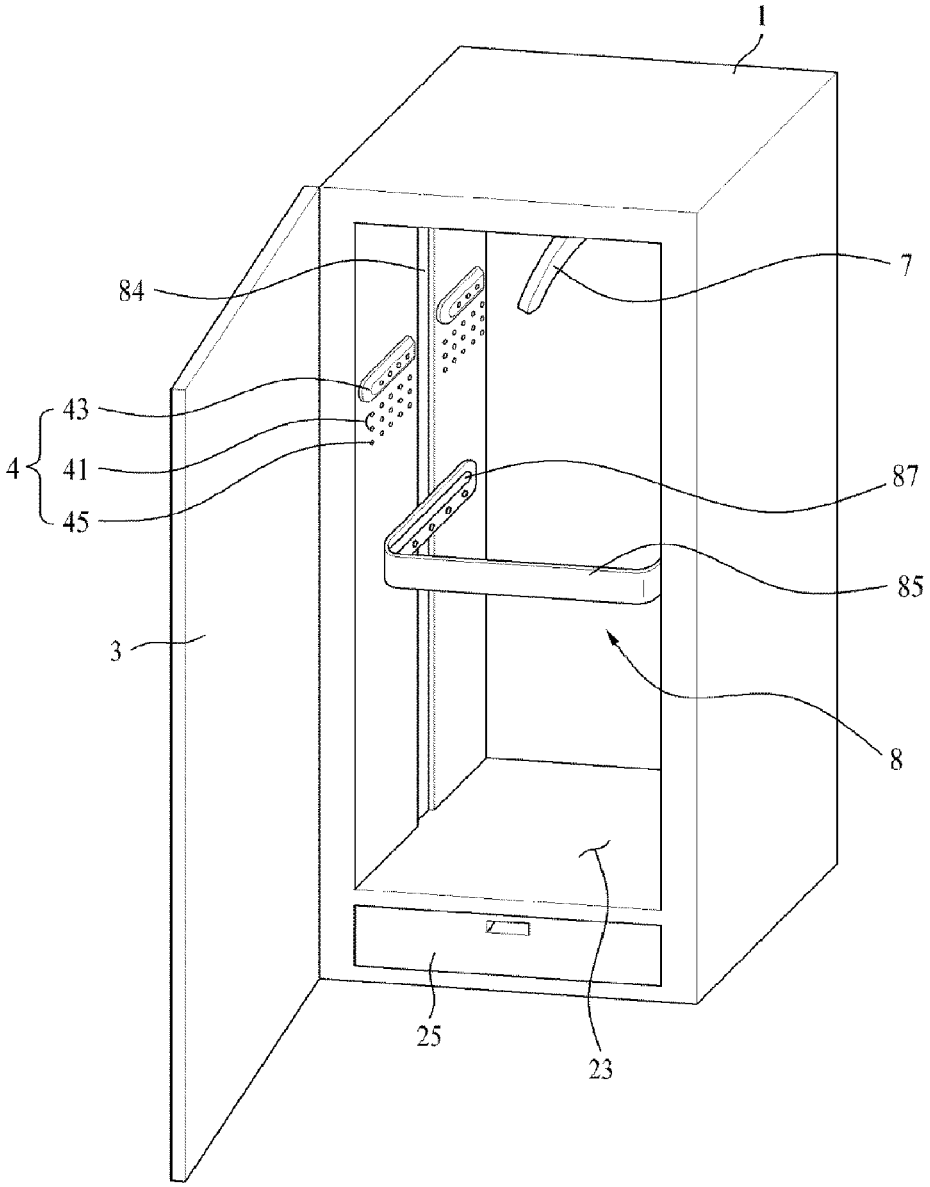

[Fig. 6]
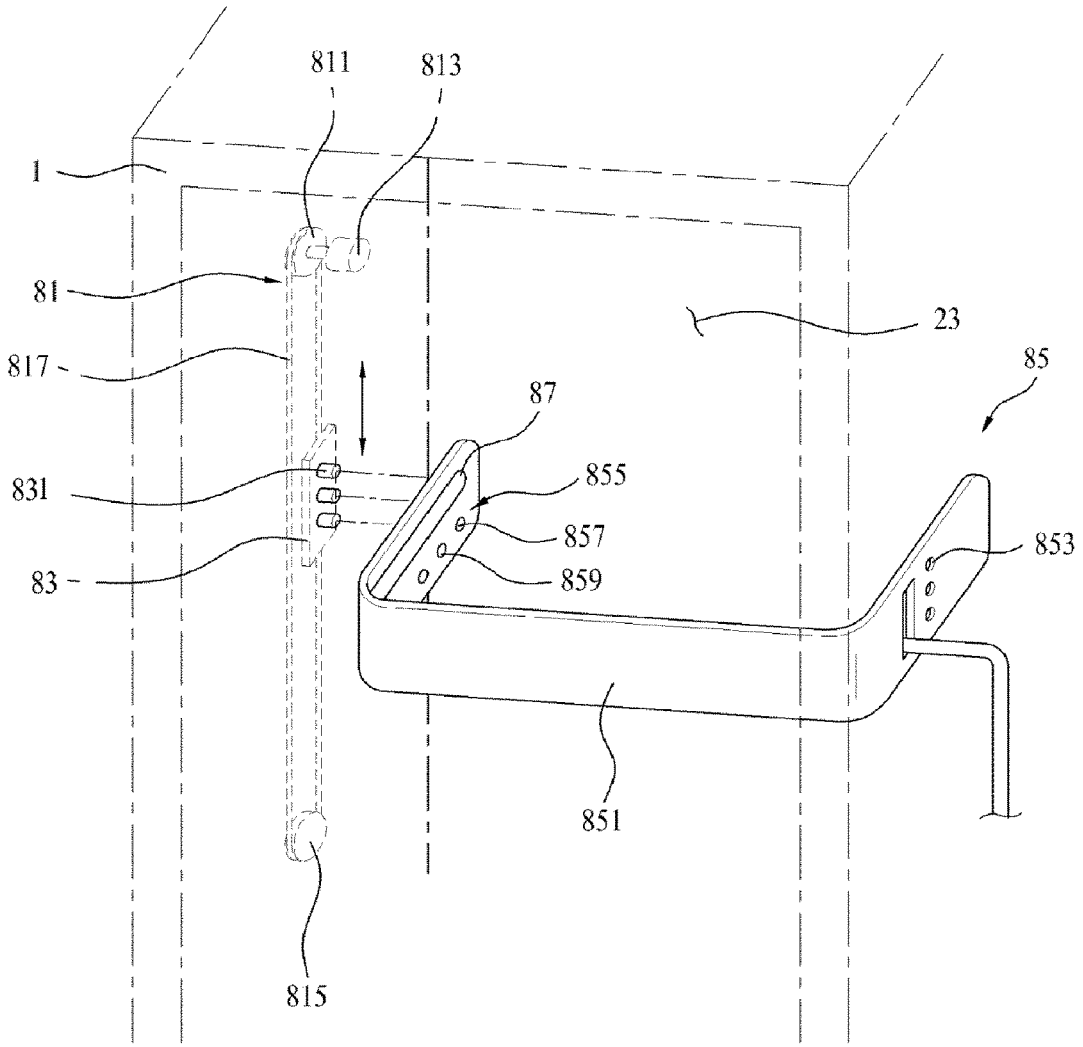

[Fig. 7]
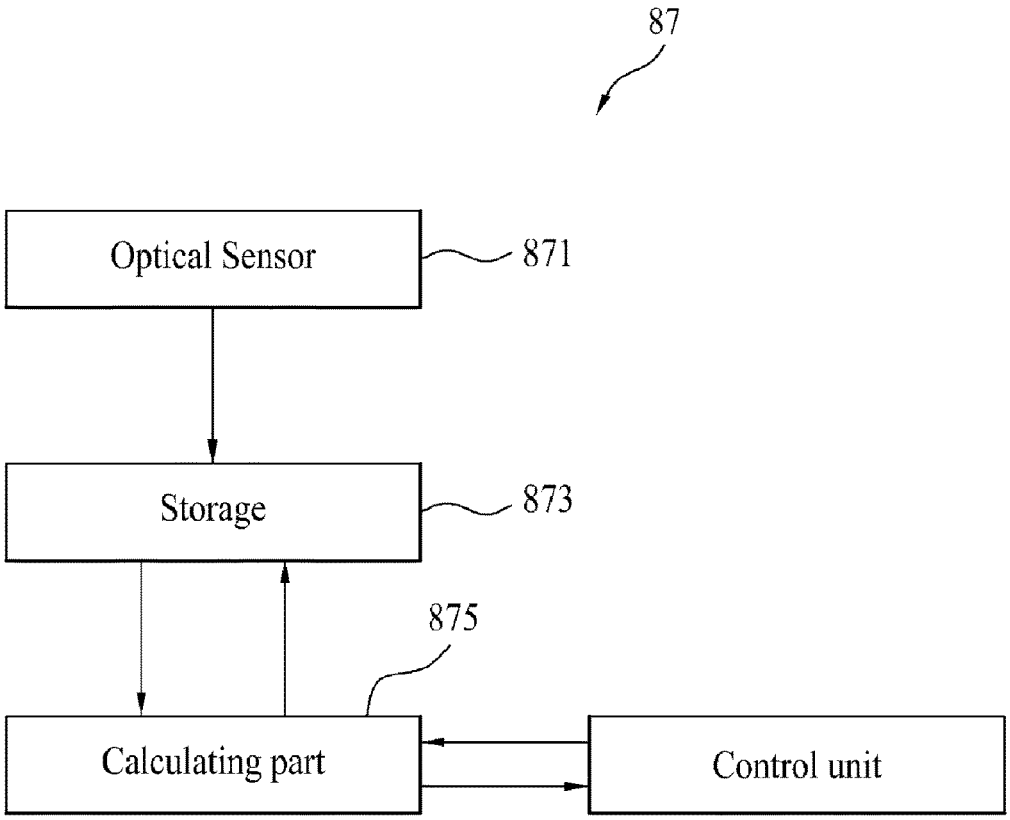

[Fig. 8]
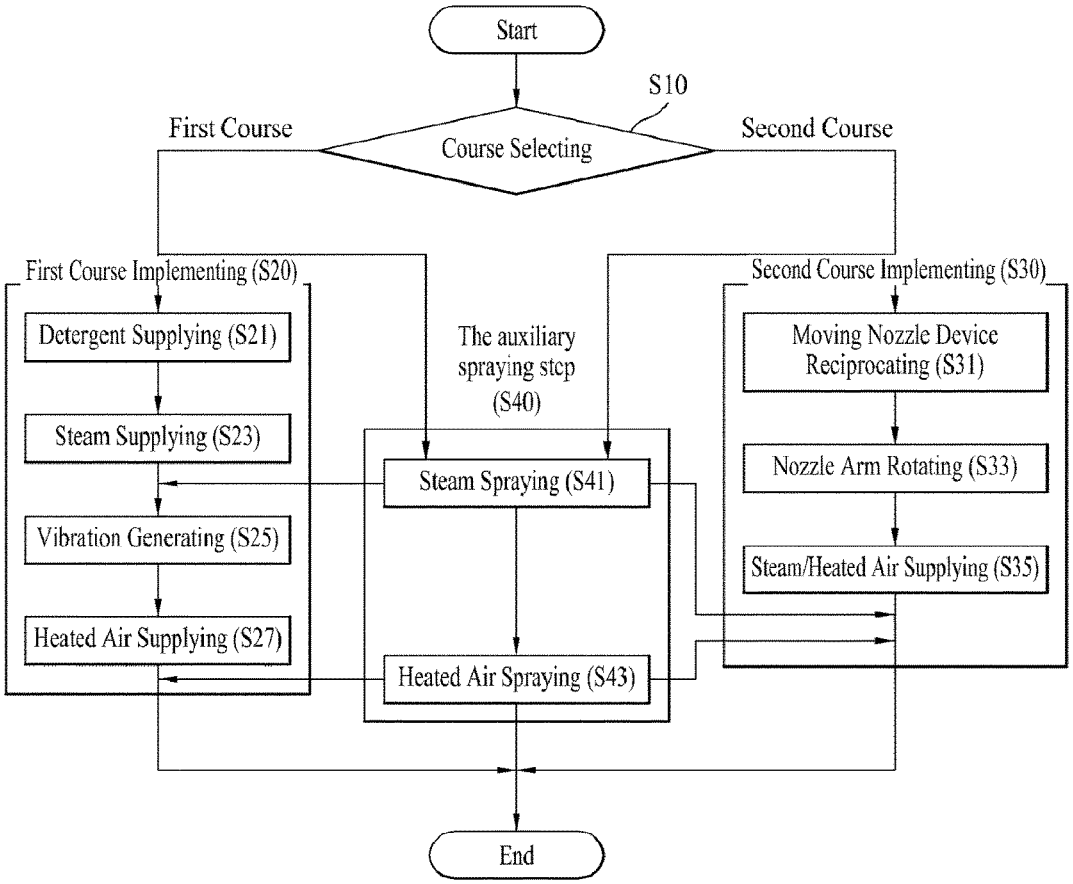

[Fig. 9]
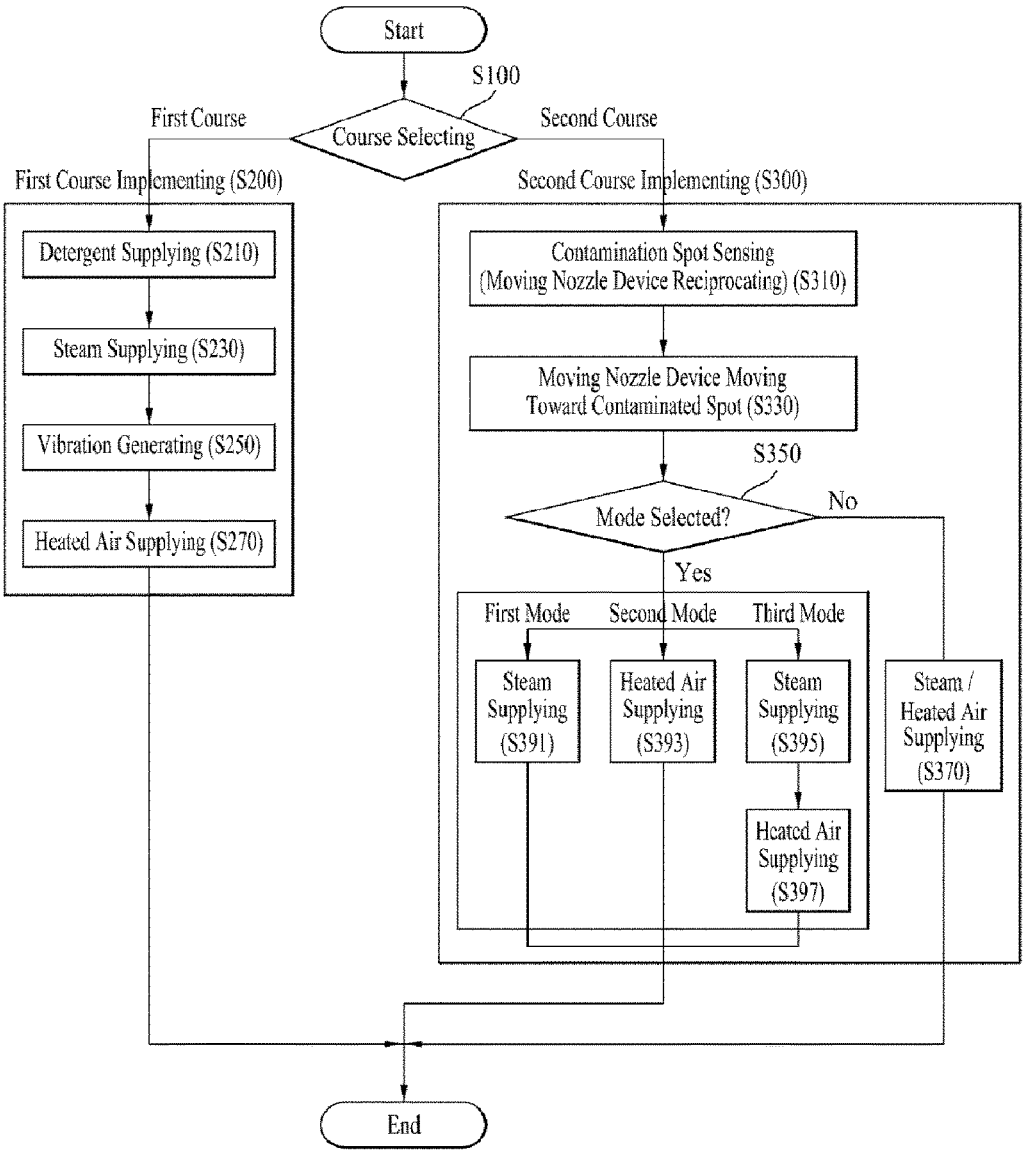

CLOTHES TREATMENT APPARATUS AND CONTROL METHOD THEREOF

This application is a divisional Application of Ser. No. 13/581,979, filed Aug. 30, 2012, now allowed, which is National Stage Entry of International Application No. PCT/KR2011/001462, filed Mar. 3, 2011, and claims the benefit of Korean Application Nos. 10-2010-0018932, filed on Mar. 3, 2010, 10-2010-0018931 filed on Mar. 3, 2010, 10-2010-0018930, filed on Mar. 3, 2010, 10-2010-0018929, filed on Mar. 3, 2010, all of which are hereby incorporated by reference for all purposes as if fully set forth herein.

TECHNICAL FIELD

The present invention relates to a clothes treatment apparatus and a control method thereof.

BACKGROUND ART

Recently, various types of clothes treatment apparatuses as well as washing machines capable of washing clothes have been used more and more. For example, there have been developed drum type dryers capable of drying washed clothes, cabinet type dryers capable of drying clothes hung therein and cabinet type refreshers capable of refreshing clothes by using heated air supplied to the clothes. However, the cabinet type clothes treatment apparatuses have several problems.

DISCLOSURE OF INVENTION

Technical Problem

The present invention is invented to improve such a conventional cabinet type clothes treatment apparatus and an object of the present invention is to provide a clothes treatment apparatus capable of refreshing clothes more effectively.

Solution to Problem

To achieve these objects and other advantages and in accordance with the purpose of the invention, as embodied and broadly described herein, a clothes treatment apparatus includes a cabinet comprising an accommodation space to accommodate clothes therein; a heated air generating device configured to generate heated air; a steam generating device configured to generate steam; and a moving nozzle device configured to supply at least one of the steam and heated air to the accommodation space selectively, with moving within the accommodation space in communication with the heated air generating device and the steam generating device.

In another aspect of the present invention, a control method of a clothes treatment apparatus including a fixed nozzle device fixed to an inside of an accommodation space accommodating clothes therein to supply at least one of steam, heated air and detergent to the accommodation space and a moving nozzle device movably provided in the accommodation space to supply at least one of the steam and heated air to the accommodation space, the control method includes a course selecting step configured to select a first course for treating the clothes by using the fixed nozzle device or a second course for treating the clothes by using the moving nozzle device; a first course implementing step configured to supply at least one of the steam, heated air and detergent to the clothes via the fixed nozzle device, when the first course is selected; and a second course implementing step configured to supply at least one of the steam and heated air to the clothes via the moving nozzle device, when the second course is selected.

Advantageous Effects of Invention

The present invention has following advantageous effects.

The clothes treatment apparatus includes a fixed nozzle device and a moving nozzle device to supply at least one of steam and heated air to clothes. As a result, the clothes may be washed effectively or refreshed.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings:

FIG. 1 is a perspective view illustrating a clothes treatment apparatus according to an exemplary embodiment of the present invention;

FIG. 2 is a perspective view illustrating a moving nozzle device;

FIG. 3 is a rear view illustrating the moving nozzle device;

FIG. 4 includes a front view illustrating a hanger device and a diagram illustrating a state of an extendable part being extended from the hanger device;

FIG. 5 is a diagram illustrating a second accommodation space according to another embodiment which is provided in the clothes treatment apparatus according to the present invention;

FIG. 6 is a perspective view illustrating a moving nozzle device provided in the second accommodation space according to the embodiment shown in FIG. 5;

FIG. 7 is a block view illustrating a configuration of a contamination sensing part provided in the second accommodation space according to the second embodiment shown in FIG. 5;

FIG. 8 is a flow chart illustrating a control method of a clothes treatment apparatus according to an embodiment of the present invention; and FIG. 9 is a flow chart illustrating a control method of a clothes treatment apparatus according to another embodiment of the present invention.

BEST MODE FOR CARRYING OUT THE INVENTION

As follows, an exemplary embodiment of the present invention will be described in detail in reference to the accompanying drawings.

Reference will now be made in detail to the specific embodiments of the present invention, examples of which are illustrated in the accompanying drawings.

Wherever possible, the same reference numbers will be used throughout the drawings to refer to the same or like parts.

The present specification presents a refresher capable of refreshing clothes as clothes treatment apparatus. However, the present invention is not limited to the refresher. That is, a subject matter of the present invention may be applicable to a dryer capable of drying clothes, with a heat pump.

Here, the term 'refresh' means a process in which wrinkle removing, deodorizing, sanitizing, static electricity preventing and warming are performed by using air or heated air supplied to clothes (hereinafter, referenced to as 'heated air' for convenience sake) or water, mist or steam (hereinafter, referenced to as 'steam' for convenience sake) supplied to clothes.

In addition, the term 'clothes' includes not only clothes and apparel but also wearable objects including shoes, socks, gloves, hats and mufflers and useable objects including dolls, towels and beddings, and it includes all kinds of washable objects.

FIG. 1 is a perspective view illustrating a clothes treatment apparatus 100. The clothes treatment apparatus 100 includes a cabinet 1 forming an exterior appearance thereof and an accommodation space 2 provided in the cabinet to accommodate clothes therein.

The cabinet 1 defines an exterior appearance of the clothes treatment apparatus 100 and the accommodation space 2 may include at least one room where clothes are accommodated.

This embodiment presents a clothes treatment apparatus including two accommodation spaces, in other words, a first accommodation space 21 and a second accommodation space 23. However, three or more accommodation spaces may be provided in the cabinet.

The accommodation spaces 21 and 23 may be selectively opened and closed by a door 3 coupled to the cabinet 1. Different from FIG. 1, the door 3 may be configured of a first door used to open and close only the first accommodation space and a second door used to open and close only the second accommodation space.

The volume, length and width of the first accommodation space 21 may be identical to those of the second accommodation space 23. Alternatively, at least one of the volume, length and width of the second accommodation space may be different from corresponding at least one of the volume, length and width of the first accommodation space.

FIG. 1 shows that the volume of the second accommodation space 23 is smaller than that of the first accommodation space 21. This is because a variety of devices provided in the clothes treatment apparatus have to be provided in a mechanism chamber located below the second accommodation space.

In other words, the mechanism chamber 25 may be provided in a predetermined space located between the second accommodation space 23 and the cabinet 1. As shown in FIG. 1, a space formed between a bottom surface of the second accommodation space 23 and the cabinet 1 may be where the mechanism chamber 25 is located.

Within the mechanism chamber 25 may be provided a variety of components configured to operate the clothes treatment apparatus. A steam generating device and a heated air generating device may be provided in the mechanism chamber 25.

In the mechanism chamber 25 may be provided the steam generating device (not shown) configured to generate steam which will be supplied to clothes accommodated in the first accommodation space 21 and the second accommodation space 23.

The steam generating device may include a predetermined housing (not shown) configured to store water therein or pass water there through and a heater (not shown) configured to heat the water provided in the housing. In the meanwhile, the clothes treatment apparatus 100 according to the present invention may further includes a steam supply path (not shown) configured to allow the housing to communicate with the accommodation spaces to supply the steam generated in the steam generating device to the first and second accommodation spaces 21 and 23.

The steam supplied by the steam generating device has a property of moving upward, because it has a high temperature. When the mechanism chamber 25 is located between the bottom surface of the second accommodation space 21 and the cabinet 1, with the steam generating device located in the mechanism chamber 25, an advantage may be expected that the steam can be supplied to the accommodation spaces even without auxiliary devices used to guide the steam toward the accommodation spaces.

Furthermore, a heated air generating device (not shown) configured to supply heated air to the accommodation spaces 21 and 23 may be further provided in the mechanism chamber 25. In this case, it is preferable that the clothes treatment apparatus according to the present invention include a heated air supply path (not shown) allowing the heated-air supply device to communicate with each of the accommodation spaces 21 and 23, such that the heated air generated in the heated air generating device may be supplied to the first and second accommodation spaces 21 and 23.

The structure of the heated air generating device (not shown) may be various types. For example, the heated air generating device may include a fan provided in a duct configured to make each of the accommodation spaces 21 and 23 in communication with external air of the cabinet 1, such that only air (here, "air" means "not-heated-air") may be supplied to each of the accommodation spaces 21 and 23.

Alternatively, the heated air generating device may include a heater and a fan, which are provided in the duct configured to make each of the accommodation spaces communicate with external air of the cabinet. Because of that, the external air of the cabinet 1 may be heated by the heater. After that, the heated air may be supplied to each of the accommodation spaces 21 and 23 via the fan. In this case, the heated air supplied to each of the accommodation spaces 21 and 23 may be heat-exchanged with the clothes accommodated in each of the accommodation spaces 21 and 23, to be exhausted to the outside of the cabinet 1.

Alternatively, the heated air generating device may include a heater, a fan and a dehumidifying device which are located in a circulation duct configured to circulate internal air of the accommodation spaces 21 and 23. After air sucked into the circulation duct is dehumidified and heated, the dehumidified and heated air may be resupplied to each of the accommodation spaces 21 and 23.

In the meanwhile, the clothes treatment apparatus may include a fixed nozzle device 4 provided in each inner circumferential surface of the first and second accommodation spaces 21 and 23. The fixed nozzle device 4 may supply at least one of the heated air generated in the heated air generating device and the steam generated in the steam generating device to each of the accommodation spaces 21 and 23.

The fixed nozzle device 4 may be fixed to the inner circumferential surface of each accommodation space 21 and 23 and it may include at least one of a heated air supply hole 41 configured to spray the heated air and a steam supply hole 43 configured to spray the steam.

The plurality of the heated air supply holes 41 may be provided in each inner circumferential surface of the accommodation spaces 21 and 23, with communicating with the heated air supply path (not shown). Because of that, the plurality of the heated air supply holes 41 may allow the heated air generated from the heated air generating device described above to be supplied to each of the accommodation spaces 21 and 23.

The plurality of the steam supply holes 43 may be provided in each inner circumferential surface of the accommodation spaces 21 and 23, with communicating with the steam supply path (not shown) mentioned above. Because of that, the plurality of the steam supply holes 43 may allow the steam generated from the steam generating device to be supplied to each of the accommodation spaces 21 and 23.

In the meanwhile, the fixed nozzle device 4 may further include a detergent supply device (not shown) and a detergent supply hole 45 which are configured to supply detergent to the first and second accommodation spaces 21 and 23.

This is because it is better to wash clothes put one for a short time period or having little contamination by using the clothes treatment apparatus according to the present invention simply, than to wash the clothes by using a washing machine.

In other words, detergent stored in the detergent supply device (not shown) is sprayed to the clothes accommodated in each of the accommodation spaces 21 and 23 via the detergent supply hole 45. When the steam or the heated air is supplied to the clothes after the detergent is supplied, it may be possible to wash the clothes having not severe contamination by using the clothes treatment apparatus according to the present invention.

Here, it is preferable that the detergent stored in the detergent supply device is liquid detergent, rather than solid detergent, in other words, powdery detergent. This is because the clothes treatment apparatus according to the present invention is an apparatus treating clothes for treating clothes without using wash water.

Furthermore, the clothes treatment apparatus according to the present invention may include a device configured to apply predetermined motion such as vibration to the clothes located in each of the accommodation spaces 21 and 23.

In case the liquid detergent or steam is sprayed to the clothes, the clothes could be wet. Because of that, the clothes are moved to remove the moisture remaining in the clothes, for example shaken after having the detergent or the steam sprayed thereto and moisture remaining in the clothes may be removed.

In the meanwhile, the device for applying vibration to the clothes may be embodied in various ways. For example, a device capable of applying vibration to a hanger on which the clothes are hung may be provided. Such a device capable of applying vibration to the clothes will be described in detail later.

The clothes treatment apparatus 100 according to the present invention may further include a moving nozzle device 5 configured to supply at least one of steam and heated air to the clothes accommodated in each of the accommodation spaces 21 and 23. It is preferable that the moving nozzle device 5 is movable within the first and second accommodation spaces 21 and 23, because clothes treatment efficiency can be improved.

As follows will be described in reference to FIGS. 2 and 3 the structure of the moving nozzle device 5 provided in the clothes treatment apparatus according to the present invention.

The moving nozzle device 5 may include a guide part 51 which is able to linearly reciprocate in an upward and downward direction inside each of the first and second accommodation spaces 21 and 23, a nozzle moving part 53 capable of reciprocating along the guide part 51, and a nozzle arm 57 capable of rotating with respect to the nozzle moving part 53.

The guide part 51 may be provided in various directions which allow the reciprocation performed inside the accommodation spaces. It is preferable that the guide part 51 is provided vertically within each of the accommodation spaces as shown in FIG. 1.

This is because the guide part 51 has to enable the nozzle arm 57, which will be described later, to supply steam or heated air, with moving.

The structure which reciprocates the nozzle moving part 53 along the guide part 51 may be embodied in various methods. For example, the nozzle moving part 53 may include a motor (not shown) and a pinion provided in a rotation shaft of the motor and the guide part 41 may include a rack corresponding to the pinion.

Alternatively, the guide part may include a pair of pulleys provided in a top and a bottom of each accommodation space, a chain or wire connecting the pair of the pulleys with each other, a motor rotating one of the pulleys such that the nozzle moving part may be fixed to the chain or the wire. Detailed description of this structure will be made later in reference to FIG. 6.

It is preferable that the nozzle arm 57 is rotatable with respect to the nozzle moving part 53 at a predetermined angle. For that, an arm supporting part 55 rotatably provided in the nozzle moving part 53 may be provided in the moving nozzle device 5.

In other words, as shown in FIG. 3, the arm supporting part 55 is coupled to the nozzle moving part 53 via a rotation shaft (S1) and it may be rotated about the rotation shaft (S1) by driving means such as a motor.

In this case, the pair of the nozzle arms 57 may be provided in both opposite ends of the arm supporting part 55, respectively. The nozzle arms 57 provided in the ends of the arm supporting part 55 may be rotatable with respect to the arm supporting part.

As a result, the pair of the nozzle arms 57 may perform symmetrical motion with respect to the rotation shaft (S1) when the arm supporting part 55 is rotated.

Here, the clothes (C) held in each of the accommodation spaces may be located in a predetermined space formed by the pair of the nozzle arms 57. It is preferable that the nozzle arms 57 are secured to the arm supporting part 55 via the rotation shaft (S2) to make the steam nozzle 573 toward the clothes (C) when the arm supporting part 55 is rotated.

Here, the pair of the arm supporting parts 55 may be provided as shown in FIG. 3 such that they may supply steam or heated-air toward the clothes even during the rotation of the arm supporting part.

In other words, when the pair of the nozzle arms 57 are coupled to the pair of the arm supporting parts via the rotation shaft (S2), respectively, a heated-air nozzle (571, which will be described later), a steam nozzle (573, which will be described later) may be always toward the clothes (C) during the rotation of the arm supporting parts 55.

In the meanwhile, it is preferable that the pair of the arm supporting parts 55 may be controlled to be rotatable in both directions within a preset angle (A). This is because the pair of the nozzle arms 57 cannot be rotated in a single direction by the clothes (C) located between the pair of the nozzle arms.

By extension, according to the present invention, a driving part (not shown) configured to rotate the arm supporting parts 55 may be controlled to change the rotational direction of the nozzle arm if the nozzle arms 57 collide with the clothes (C) such that the nozzle arms 57 may be rotated in both directions within a preset angle range (A).

The nozzle arms 57 may include at least one heated air nozzle 571 in communication with the heated air generating device (not shown) and at least one steam nozzle 573 in communication with the steam generating device.

The heated air nozzle 571 may communicate with the heated air generating device via the heated air supply path (not shown) and the steam nozzle 573 may communicate with the steam generating device via the steam supply path (not shown).

In the meanwhile, the heated air supply path and the steam supply path may be connected with nozzles 571 and 573 provided in the nozzle arms 57 via the nozzle moving part 53. In this case, it is preferable that the heated air supply path and the steam supply path may have an extendible structure, in other words, a telescopic or foldable structure.

This is because the connection between the heated air nozzle 571 and the heated air supply device and the connection between the steam nozzle 573 and the steam generating device have to be maintained even when the nozzle moving part 53 is reciprocating within each of the accommodation spaces.

When the arm supporting parts 55 are rotating, the nozzle arms 57 may approach to the clothes (C). If then, the nozzle arms 57 may contact with the clothes according to the type and volume of the clothes. Because of that, the nozzle arm may include a pressing member projected from a surface of the nozzle.

The pressing member may be a ball member 575 which can be rotatable, with a predetermined portion thereof projected from the surface of the nozzle arm 57, as shown in FIG. 2.

Because of that, the ball member may prevent damage to fabric of the clothes which might be caused by the nozzle arm, even if the nozzle arm 57 contact with the clothes (C) during the rotation of the arm supporting part.

Moreover, the nozzle arm 57 may further include a contamination sensing part (not shown) configured to determine a contaminated spot of the clothes.

The contamination sensing part is means for detecting a contaminated spot of the clothes when the nozzle arm 57 is reciprocated by the nozzle moving part 53. In this case, the clothes treatment apparatus according to the present invention may include a control unit configured to control the motion of the nozzle moving part and the operation of the nozzle arm, to supply steam or heated air only to the contaminated spot of the clothes.

The configuration and controlling process of the contamination sensing part will be explained in detail when an embodiment shown in FIG. 5 is described.

In the meanwhile, when steam is supplied to the clothes (C) by the nozzle arm 57 while the nozzle arm 57 is rotated by the arm supporting part, the steam may be supplied to the clothes (C) in a short distance. Because of that, the clothes could be wet as the steam sprayed toward the clothes is condensing and the clothes held in the accommodation spaces could be wet by liquid detergent sprayed from the detergent supply hole 45.

Moreover, in case the clothes not dried after washed may be held in each of the accommodation spaces are dried by the heated air generating device, the clothes held in each of the accommodation spaces are in a state of being wet.

As a result, the clothes treatment apparatus according to the present invention may further include a device configured to remove the moisture or liquid detergent contained in the clothes, in case the clothes contain a predetermined amount of moisture or liquid detergent.

This moisture removing device may be provided in various structures. FIG. 4 illustrates a hanger device 7 capable of providing the held clothes with vibration as this moisture removing device.

FIG. 4 illustrates a front view of the hanger device and it illustrates an extended part extended from the hanger device.

The hanger device 7 may include a supporting bar 71 where the clothes are supported and a vibration generating part 75 configured to vibrate the supporting bar 71.

A detaching part 72 may allow the supporting bar 71 to be attachable to detachable from a connection pipe 6 provided in each of the accommodation spaces 21 and 23. A hanger body 73 provided below the supporting bar may be located in the clothes to support the clothes.

In addition, the hanger device 7 may further include an extendable part 74 to support long clothes. It is preferable that the extendable part 74 may be extendable toward an outside of the hanger body by a user selectively, even when it is located in the hanger body 73.

Here, the extendable part 74 may be automatically extendable toward the outside of the hanger body by driving means, for example, a motor.

The vibration generating part 75 may be a vibration pad provided in the hanger body 73 to provide the clothes hung on the supporting part with vibration. The vibration pad means a device including a vibration generation source capable of generating vibration.

This is because the clothes have to be vibrated to remove the moisture contained in the clothes, if the clothes contain the moisture.

In the meanwhile, it is preferable that the control unit configured to control the steam generating device and the heated air generating device described above controls the vibration pad to be put into operation when the steam is supplied to the clothes via the moving nozzle device 5 or the fixed nozzle device 4.

Here, the present invention may not exclude a case of the vibration pad put into operation by the user's selection.

The hanger device 7 may further include a spraying device 76 configured to supply steam or heated air to the clothes hung on the supporting bar 71. This is because the steam or the heated air has to be sprayed from a position nearest to the clothes accommodated in each of the accommodation spaces 21 and 23 to enhance refreshing efficiency and drying efficiency of the clothes.

The spraying device 76 may be provided in the hanger body 73 as shown in FIG. 4 or it may be provided in the supporting bar 71, different from FIG. 4.

The spraying device 76 includes a first heated air path 761 allowing heated air to flow there through and a first steam path 763 allowing steam to flow there through. In addition, it is preferable that the spraying device 76 includes a plurality of holes capable of spraying the heated air or the steam sucked through the first heated air path or the first steam path.

The first heated air path 761 and the first steam path 763 may be configured to connect the detaching part 72 with the holes of the spraying device 76.

It is preferable that a second heated air path 61 configured to supply the heated air generated from the heated air generating device and a second steam path 63 configured to supply the steam generated from the steam generating device to the first steam path 763 may be provided in the connection pipe 6 having the detaching part detachable there from.

The second heated air path 61 may be in communication with the heated air generating device and the second steam path 63 may be in communication with the steam generating device.

Because of that, the detaching part 72 of the hanger device 7 is connected to the connection pipe 6 provided in each of the accommodation spaces, and then the first heated air path 761 is connected with the second heated air path 61 and the first steam path 763 is connected to the second seam path 63. After that, the steam and the heated air generated from the steam generating device and the heated air generating device may be sprayed toward the clothes via the spraying device 76.

Here, the second heated air path 61 may be branched from the heated air supply path (not shown) and the second steam path 63 may be branched from the steam supply path (not shown).

In the meanwhile, the clothes treatment apparatus according to the present invention may include a control unit configured to control the steam generating device, the heated air generating device, the fixed nozzle device 4, the moving nozzle device 5, the spraying device 76 and the vibration generating part 75.

The control unit (not shown) may control the variety of the components described above. When the accommodation space 2 includes a plurality of spaces, a plurality of control units may be provided correspondingly.

In other words, when the accommodation space 2 includes the first and second accommodation spaces 21 and 23 as shown in FIG. 1, the control unit may include a first control unit (not shown) configured to control a device provided in the first accommodation space 21 and a second control unit configured to control a device provided in the second accommodation space 23.

It is possible to drive only a single accommodation space, in case of treating a small amount of clothes when the corresponding number of the control units to the number of the accommodation spaces. It is possible to accommodate and treat the same kind of clothes in the same accommodation space in case of treating different kinds of clothes.

FIGS. 5 to 7 illustrate another embodiment of the moving nozzle device provided in the clothes treatment apparatus according to the present invention.

Some spots of clothes put on by the user wear will be usually contaminated, not entire spots thereof. Foreign matters are usually attached to particular spots of the clothes.

In addition, clothes such as dress shirts could have wrinkles a lot and wrinkles can be generated in an elbow area, a wrist area and a waist area of such a dress shirt.

Because of that, when it is possible to detect a spot of clothes having foreign matters attached thereto or a spot having wrinkles (hereinafter, referenced to as 'contaminated spot') before supplying steam or heated air to the clothes, energy consumption of the clothes treatment apparatus may be reduced as much as possible.

This embodiment presents a moving nozzle device including a contamination sensing part capable of detecting a contaminated spot of the clothes before the clothes treatment apparatus supplies steam or heated air to the clothes, which will be described in detail as follows.

A moving nozzle device 8 shown in FIG. 5 may be provided only in the second accommodation space 23 as shown in FIG. 5 or in each of the first and second accommodation spaces 21 and 23.

For explanation sake, the present embodiment will be described, adapting the case of the moving nozzle device 8 of FIG. 5 provided only in the second accommodation space 23. Detailed description of the same components as those shown in FIG. 1 will be omitted.

The moving nozzle device 8 shown in FIG. 6 includes a guide part 81 vertically provided in the second accommodation space 23, a nozzle moving part 83 capable of reciprocating along the guide part 81, a nozzle arm 85 coupled to the nozzle moving part, in communication with the steam generating device and the heated air generating device, and a contamination sensing part 87 provided in the nozzle arm 85 to detect a contaminated spot of the clothes.

The contamination sensing part 87 may be separated from the movable nozzle arm 85 to detect the contaminated spot of the clothes accommodated in the second accommodation space 23. However, when the contamination sensing part 87 is provided in the nozzle arm, detecting of the contaminated spot and supplying of steam or heated air to the contaminated spot may be performed simultaneously and advantageously.

The guide part 81 may include a driving pulley 811 coupled to a rotation shaft of a motor 813 located in each of opposite ends or a predetermined portion of the second accommodation space 23 and a driven pulley 815 receiving a power from the driving pulley via a wire 817 or a chain.

Here, it is preferable that the guide part 81 is located between the second accommodation space 23 and the cabinet 1 not to be exposed within the second accommodation space, in an aspect of durability maintenance or an aesthetic point of view.

The nozzle moving part 83 is coupled to a predetermined portion of the wire 817 or chain and it includes at least two projections 831. In this case, a guider (not shown, configured to support the other portion of the nozzle moving part) is provided in the other portion of the nozzle moving part such that the nozzle moving part 83 may be movable more stably.

The projections 831 are provided toward the inside of the second accommodation space 23 along an opening (84, see FIG. 5) provided in the second accommodation space 23, to be coupled to grooves 853 provided in a body of the nozzle arm 85.

Because of that, when the driving pulley is rotated by the motor, the wire is moved to upper and lower portions of the second accommodation space and the nozzle moving part 83 fixed to the wire is reciprocated within the second accommodation space accordingly.

The nozzle arm 85 is supported by the nozzle moving part 83 and it is reciprocated within the second accommodation space. Also, the nozzle arm 85 supplies at least one of the steam and heated air to the clothes held in the second accommodation space.

For that, the nozzle arm 85 includes a body 851 having a bending shape to surround the clothes held in the second accommodation space and a nozzle part 855 provided in the body, in communication with the heated air generating device and the steam generating device.

The reason why the body 851 is provided in the shape for surrounding the clothes is that the nozzle arm 85 had better to supply steam or heated air toward all directions of the clothes, with reciprocating vertically along the clothes held in the second accommodation space.

Here, FIG. 6 illustrates the body 851 capable of supplying steam or heated air toward the other sides of the clothes except a side toward a rear surface of the second accommodation space.

Different from that, the body 851 may supply steam or heated air to the other all sides of the clothes except a side toward a front surface of the second accommodation space.

An additional advantage of convenient hanging or withdrawing of the clothes within or from the second accommodation space may occur when the shape of the body is configured to enable the steam or the heated air to be supplied to the other sides of the clothes except a single side.

The nozzle part 855 includes a steam nozzle 859 in communication with the steam generating device and a heated air nozzle 857 in communication with the heated air generating device. It is preferable that the heated air nozzle and the steam nozzle are provided in an inner circumferential surface of the body to supply steam or heated air to the clothes located in an inner space of the body 851.

In the meanwhile, the moving nozzle device 8 according to this embodiment provided the clothes treatment apparatus may further include the contamination sensing part 87 provided in the inner circumferential surface of the body 851 to detect a contaminated spot of the clothes.

As shown in FIG. 7, the contamination sensing part 87 may include an optical sensor 871 configured to recognize a surface of the clothes optically, a storage 873 configured to store surface information of the clothes provided by the optical sensor and reference information, and a calculating part (an operation part) 875 configured to compare the surface information stored in the storage with reference information to detect the contaminated spot of the clothes.

The optical sensor 871 recognizes a surface of the clothes optically while the body 851 is moved. For that, it is preferable that the optical sensor 871 is extended along the inner circumferential surface of the body 851 to sense the surface of the clothes.

The surface information recognized by the optical sensor is stored in the storage 873 and the storage may be provided in a nozzle net 85 or in the control unit.

The calculating part (the operation part) 875 compares the surface information stored in the storage with reference information stored after recognizing a surface of uncontaminated clothes optically (hereinafter, referenced to as 'clean information'). After the comparison, the calculating part 875 determines a contaminated spot of the clothes based on the result of the comparison and it transfers the determined spot to the control unit.

The clean information may be set to be surface information of clothes measured by the optical sensor 871 after clothes are held in the second accommodation space 23.

Contaminated spot information determined by the calculating part 875 is transferred to the control unit and the control unit controls the nozzle arm 85 to the contaminated spot of the clothes based on the contaminated spot information. After that, the control unit controls the guide part and the nozzle arm to spray at least one of the steam and heated air to the contaminated spot of the clothes.

In other words, the control unit may control the moving nozzle device 8 to supply the steam or the heated air after stopping the moving nozzle device at the contaminated spot of the clothes, not to supply the steam or the heated air to all directions of the clothes, while the moving nozzle device 8 is moving vertically along the clothes.

In the meanwhile, the nozzle part 855 includes the steam nozzle 859 configured to supply steam and the heated air nozzle 857 configured to supply heated air. Here, the plurality of the steam nozzle 859 configured to spray steam selectively and the plurality of the heated air nozzle 857 configured to spray heated air selectively may be provided.

This is because the steam and the heated air have to be supplied via only a part of the nozzle part 855 corresponding to the contaminated spot, not to be supplied via all of the nozzle part 855, after the nozzle arm is stopped at a predetermined height where the contaminated spot of the clothes are generated.

Let us assume that the contamination sensing part 87 detects a contaminated spot at a right area of a dress shirt at a middle height, which is held in the second accommodation space.

In this case, the control unit controls the nozzle arm 85 to be stopped at the middle height of the dress shirt and it controls steam and heated to be supplied via the steam nozzle 859 and the heated nozzle 857 corresponding to the right area of the dress shirt. Because of that, the clothes treatment apparatus according to the present invention may not supply steam and heated air to the other spots of the clothes without contamination and it may economize in energy accordingly.

FIGS. 8 and 9 are flow charts illustrating a control method of the clothes treatment apparatus according to the present invention. As follows, the control method will be described in detail.

First of all, a control method of the clothes treatment apparatus shown in FIG. 8 will be described.

The control method of the clothes treatment apparatus according to the present invention includes a course selecting step (S10) allowing a user to select one of courses via an input part (not shown) provided in the laundry treatment apparatus 100, and a course implementing step spraying at least one of heated air and steam to clothes held in the accommodation space (2, see FIG. 1) according to the course selected in the course selecting step.

In this case, the input part may include a display part. The display part may display a variety of information on the clothes treatment apparatus, for example, the selected course, the expected time of the course, the remaining time of the course and the temperature of the accommodation space to allow the user to recognize.

The course selecting step (S10) may allow to be selected a first course for supplying at least one of steam, heated air and detergent to the clothes via the fixed nozzle device 4 or a second course for supplying at least one of the steam and heated air to the clothes via the moving nozzle device 5.

Here, FIG. 8 presents that the course selecting step includes a case of selecting only one of the first and second courses. This is for explanation sake and the course selecting step may include selecting one of three courses or more.

The course implementing step includes a first course implementing step (S20) for supplying at least one of the steam, heated air and detergent to the clothes, when the first course is selected, and a second course implementing step (S30) for supplying at least one of the steam and heated air to the clothes, when the second course is selected.

The first course implementing step is performed by the fixed nozzle device and the second course implanting step is performed by the moving nozzle device 5 or 8.

The first course implementing step is a step for washing clothes which are not contaminated enough to be washed by using water. Because of that, at least one of the detergent, steam and heated air may be supplied to the clothes.

In addition, the first course implementing step (S20) implements a detergent supplying step (S21), a steam supplying step (S23) and a heated air supplying step (S27) sequentially. If then, one of at least two of the detergent supplying, steam supplying and heated air supplying steps may be performed while the other one of the at least two is performed.

That is, the steam supplying step may start while the detergent supplying step is performed or the heated air supplying step may start while the steam supplying step is performed.

The first course implementing step (S20) may include a vibration generating step (S25) for vibrating the clothes by using the vibration generating part provided in the hanger device 7.

The vibration generating step vibrates the clothes to remove the moisture remaining in the clothes.

In the meanwhile, the vibration generating step may be performed before the heated air supplying step, or it may be performed after the detergent supplying step or at least one time after the detergent supplying step.

The second course implementing step (S30) is a step for refreshing the clothes and it supplies at least one of the steam and heated air to the clothes via the moving nozzle device 5.

The second course implementing step may include a step of reciprocating the moving nozzle device (S31), a step of rotating the nozzle arm (S33) and a step of supplying at least one of steam and heated air (S35).

It is not necessary to perform the reciprocating step, the rotating step and the supplying step sequentially, different from the first course implementing step.

In other words, the reciprocating step, the rotating step and the supplying step may be performed simultaneously. Because of that, the nozzle arm 57 provided in the moving nozzle device 5 may perform the supplying step (S35) at the same time when starting the reciprocating step (S31). Also, the nozzle arm 55 may perform the rotating step configured to reciprocatingly rotate in a predetermined range of angles to maintain a predetermined distance from the clothes located in the accommodation space, at the same time when starting the reciprocating step.

Especially, the moving nozzle device 5 may supply steam or heated air during the reciprocating motion and reciprocating rotation along the clothes. Because of that, the second course implementing step may supply steam or heated air to the clothes more closely than the first course implementing step.

As a result, the second course implementing step has a remarkable wrinkle removal effect in comparison to the first course implementing step. Also, the ball member 575 may be provided in the moving nozzle device 5 and it may be expected that the second course implementing step may have an ironing effect to iron wrinkles of the clothes, because the ball member contacts with the clothes during the reciprocating rotation of the nozzle arm 57.

The control method according to this embodiment may further include an auxiliary spraying step (S40) for supplying at least one of the steam and heated air to the clothes supported by the supporting bar 71 via the spraying device 76 provided in the hanger device 7, while the first course implementing step and the second course implementing step are performed.

The auxiliary spraying step (S40) may include at least one of steam spraying and heated air spraying steps (S41) and (S42).

When the auxiliary spraying step is performed, a spraying object of the auxiliary spraying step may be identical to a spraying object of the fixed nozzle device 4 and the moving nozzle device 5 or 8.

In other words, when the first course implementing step and the second implementing step supply steam, the auxiliary spraying step (S40) may perform a steam spraying step (S41) supplying steam to the clothes hung on the supporting bar 71. When the first course implementing step and the second course implementing step supply heated air, the auxiliary spraying step (S40) may perform a heated air spraying step (S43) supplying heated air to the clothes hung on the supporting bar.

Alternatively, the auxiliary spraying step (S40) may perform a spraying step for a different spraying object from the spraying object of the first course implementing step and the second course implementing step.

In other words, when the first course implementing step and the second course implementing step supply steam, the auxiliary spraying step (S40) may perform the heated air supplying step (S43) supplying heated air to the clothes hung on the supporting bar. When the first course implementing step and the second course implementing step supply heated air, the auxiliary spraying step (S40) may perform the steam supplying step (S41).

Here, when the user selects a third course set to be the auxiliary spraying step (S40) in the course selecting step (S10), the auxiliary spraying step (S40) may supply at least one of the steam and heated air to the clothes hung on the supporting bar 71 via the spraying device 76 provided in the hanger device 7.

In this case, the spraying device 76 may supply steam or heated air from the inside of the clothes hung on the supporting bar 71. Because of that, the steam or heated air may be supplied from the location where the steam or heated air sprayed via the moving nozzle device and the fixed nozzle device fails to reach. The refreshing ability of the clothes treatment apparatus according to the present invention may be enhanced accordingly.

The operation time of the third course configured to supply steam or heated air via the spraying device 76 may be adjustable according to the user's selection.

In other words, the user directly inputs the operation time of the third course via the input part (not shown) or the control unit provided in the clothes treatment apparatus according to the present invention may set the operation time of the third course when he or she selects the kind of the clothes accommodated in the accommodation space. In this case, the input part of the clothes treatment apparatus may further include a clothes selecting part (not shown) configured to allow the user to select the kind of the clothes.

FIG. 9 illustrates a control method of the clothes treatment apparatus according to another embodiment. The control method includes a course selecting step (S100), a first course implementing step (S200) and a second implementing step (S300).

The course selecting step (S100) and the first course implementing step (S200) are almost identical to those of the embodiment described above in reference to FIG. 8. As follows, only the second course implementing step (S300) will be described.

The second course implementing step (S300) determines a contaminated spot of the clothes by using the contamination sensing part provided in the moving nozzle device and it supplies at least one of the steam and heated air only to the contaminated spot.

In other words, the second course implementing step includes a step for sensing a contaminated spot of the clothes by using the contamination sensing part 87 while reciprocating the moving nozzle device (5 or 8, see FIG. 1 or FIG. 5) along the clothes held in the accommodation space.

When the contamination sensing step (S310) determines the contaminated spot of the clothes, the second course implementing step includes a moving step (S330) for moving the moving nozzle device to the contaminated spot of the clothes and a spraying step (S370) for spraying steam or heated air to the clothes.

The spraying step (S370) supplies steam or heated air to the contaminated spot of the clothes, not to uncontaminated spots, which is described above. Detailed description of this configuration will be omitted accordingly.

In the meanwhile, the second course implementing step according to this embodiment may further include a mode identifying step (S350) provided before a spraying step (S390).

The mode identifying step (S350) selects one of modes differentiated according to whether a spraying object supplied to the clothes is steam or heated air. The mode identifying step (S350) may includes a selecting step for selecting one of first, second and third modes. The first mode is for supplying steam to the clothes and the second mode is for supplying heated air to the clothes. The third mode is for supplying both of them to the clothes.

As a result, the user may select an operational mode of the clothes treatment apparatus according to the kinds of clothes and a contamination level of clothes.

That is, in case wrinkle removal of clothes is a main object, the user may select the first mode configured to supply steam to clothes. In case foreign matter removal is a main object, the user may select the second mode configured to supply heated air to clothes.

In this case, it is preferable that the second mode sprays heated air with a preset pressure or more to remove dust from the clothes. For that, the heated air generating device may further include pressing means (not shown). The pressing means may be configured of a predetermined pump capable of applying a pressure to the heated air generated in the heated air generating device.

In case the main object is to remove wrinkles and foreign matters of clothes, the user may select the third mode.

The mode identifying step requires a mode selecting step (not shown) allowing the user to select a specific mode. The mode identifying step has to be performed only before the spraying step (S390). Because of that, the mode selecting step may be performed after the course selecting step (S100).

Although not shown in the drawings, the first mode may include a step supplying heated air after steam supplying (S391). The moisture contained in the clothes has to be removed, because the steam supplying could dampen the clothes.

When the heated air is supplied after the steam supplying (S391), the moving nozzle device may be controlled to supply the heated air only to the contaminated spot and to supply the heated air while reciprocating vertically along the clothes.

In addition, it is preferable that the third mode for supplying steam and heated air together performs heated air supplying (S397) after steam supplying (S395). As mentioned above, the clothes have to be dried in case they are wet by the steam supplying.

Although not shown in the drawings, the third mode may perform heated air supplying, steam supplying and heated air supplying sequentially.

After dust attached to the clothes is removed by using heated air, the clothes are treated by using steam and heated air. As a result, dust removal and wrinkle removal abilities of the clothes treatment apparatus may be enhanced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A clothes treatment apparatus comprising:

a cabinet comprising an accommodation space to accommodate clothes therein;

a heated air generating device configured to generate heated air;

a steam generating device configured to generate steam; and a moving nozzle device configured to supply at least one of the steam and heated air to the accommodation space, with moving within the accommodation space in communication with the heated air generating device and the steam generating device, a hanger device provided in the accommodation space to hang the clothes there on, the hanger device comprising a supporting bar having the clothes hung thereon, wherein the accommodation space comprises a connection pipe in communication with the heated air generating device and the steam generating device, and the hanger device comprises a detaching pipe configured to be attached and detached to and from the connection pipe; and a spraying device configured to spray at least one of the heated air and steam to the clothes, in communication with the connection pipe.

2. The clothes treatment apparatus as claimed in claim 1, wherein the moving nozzle device is able to reciprocate and rotate within the accommodation space.

3. The clothes treatment apparatus as claimed in claim 2, wherein the moving nozzle device is able to reciprocate vertically along the clothes accommodated in the accommodation space.

4. The clothes treatment apparatus as claimed in claim 3, wherein the moving nozzle device is able to rotate in a preset range of angles capable of maintaining a predetermined distance from the clothes accommodated in the accommodation space.

5. The clothes treatment apparatus as claimed in claim 1, wherein the moving nozzle device comprises, a nozzle moving part configured to reciprocate along an inner circumferential surface of the accommodation space; and a nozzle arm rotatably coupled to the nozzle moving part, to spray at least one of the heated air and steam to the accommodation space, in communication with the heated air generating device and the steam generating device.

6. The clothes treatment apparatus as claimed in claim 5, wherein the nozzle arm is a pair of the nozzle arms which are spaced apart a predetermined distance from each other.

7. The clothes treatment apparatus as claimed in claim 6, wherein the moving nozzle device further comprises, an arm supporting part rotatably provided in the nozzle moving part, and the pair of the nozzle arms are coupled to both ends of the arm supporting part, respectively.

8. The clothes treatment apparatus as claimed in claim 5, wherein the moving nozzle device further comprises, a ball member rotatably projected from a surface of the nozzle arm.

9. The clothes treatment apparatus as claimed in claim 1, further comprising:

a contamination sensing part provided in the moving nozzle device to determine a contaminated spot of the clothes accommodated in the accommodation space; and a control unit configured to control the heated air generating device and the steam generating device and the moving nozzle device to supply at least one of the steam and heated air to the contaminated spot determined by the contamination sensing part.

10. The clothes treatment apparatus as claimed in claim 9, wherein the moving nozzle device comprises, a nozzle moving part configured to reciprocate along an inner circumferential surface of the accommodation space; and a nozzle arm coupled to the nozzle moving part, to spray at least one of the heated air and steam to the accommodation space, in communication with the heated air generating device and the steam generating device, and the contamination sensing part is provided in the nozzle arm.

11. The clothes treatment apparatus as claimed in claim 10, wherein the nozzle arm is bent to surround the clothes accommodated in the accommodation space.

12. The clothes treatment apparatus as claimed in claim 11, wherein the contamination sensing part comprises, an optical sensor configured to recognize a surface of the clothes optically;

a storage configured to store surface information provided by the optical sensor and preset reference information therein; and an operation part configured to compare the surface information with the reference information to determine a contaminated spot and to transfer the determined contaminated spot to the control unit.

13. The clothes treatment apparatus as claimed in claim 1, further comprising:

a fixed nozzle device fixed to an inner circumferential surface of the accommodation space, wherein the fixed nozzle device comprises a heated air supply hole configured to supply the heated air to the accommodation space, in communication with the heated air generating device; and a steam supply hole configured to supply the steam to the accommodation space, in communication with the steam generating device.

14. The clothes treatment apparatus as claimed in claim 13, wherein the fixed nozzle device further comprises a detergent supply hole configured to supply detergent to the accommodation space, in communication with a detergent supply device having detergent stored therein.

15. The clothes treatment apparatus as claimed in claim 1, further comprising:

a hanger device provided in the accommodation space to hang the clothes there on, the hanger device configured to apply vibration to the clothes hung thereon.

16. The clothes treatment apparatus as claimed in claim 15, wherein the hanger device further comprises a vibration generating part configured to vibrate the supporting bar.

17. The clothes treatment apparatus as claimed in claim 13, wherein the accommodation space comprises a first accommodation space and a second accommodation space, which are separatedly provided in the cabinet, and the moving nozzle device and the fixed nozzle device are provided in each of the first and second accommodation spaces.

18. The clothes treatment apparatus as claimed in claim 17, further comprising:

a mechanism chamber provided between a bottom surface of the second accommodation space and the cabinet, to mount at least one of the heated air generating device and steam generating device therein.

19. The clothes treatment apparatus as claimed in claim 18, further comprising a first control unit configured to control the moving nozzle device and the fixed nozzle device provided in the first accommodation space; and a second control unit configured to control the moving nozzle device and the fixed nozzle device provided in the second accommodation space.

* * * * *